US006880310B2

(12) United States Patent
Main et al.

(10) Patent No.: US 6,880,310 B2
(45) Date of Patent: Apr. 19, 2005

(54) METHOD FOR AUTOMATIC BALE BAG LOADING

(75) Inventors: Timothy B. Main, Selah, WA (US); Gary G. Germunson, Yakima, WA (US)

(73) Assignee: Yakima Packaging Automation, Inc., Yakima, WA (US)

( * ) Notice: Subject to any disclaimer, the term of this patent is extended or adjusted under 35 U.S.C. 154(b) by 0 days.

(21) Appl. No.: 10/255,004

(22) Filed: Sep. 24, 2002

(65) Prior Publication Data

US 2004/0055250 A1 Mar. 25, 2004

(51) Int. Cl.[7] ..... B65B 43/30
(52) U.S. Cl. ..... 53/386.1; 53/573; 53/572
(58) Field of Search ..... 53/386.1, 459, 53/571, 573, 572

(56) References Cited

U.S. PATENT DOCUMENTS

| | | | | |
|---|---|---|---|---|
| 584,659 A | | 6/1897 | Appel | |
| 1,713,341 A | | 5/1929 | Kroemer | |
| 1,895,267 A | | 1/1933 | Poppe | |
| 2,003,697 A | | 6/1935 | Poppe | 229/54 |
| 2,631,629 A | | 3/1953 | Lee | 150/1 |
| 2,790,591 A | | 4/1957 | Rosen | 229/53 |
| 3,008,569 A | | 11/1961 | Murch | 206/19.5 |
| 3,385,506 A | | 5/1968 | Ryburn | 229/53 |
| 3,646,723 A | * | 3/1972 | Meroney | 53/390 |
| 3,653,619 A | | 4/1972 | Plum | 248/99 |
| 3,691,715 A | | 9/1972 | Kelly et al. | 53/3 |
| 3,934,388 A | | 1/1976 | Stadlbauer et al. | 53/29 |
| 3,938,299 A | | 2/1976 | Lerner | 53/22 B |
| 3,945,173 A | * | 3/1976 | Buzzi | 53/571 |
| 3,955,334 A | * | 5/1976 | Wild et al. | 53/459 |
| 3,956,866 A | | 5/1976 | Lattur | 53/29 |
| 4,014,154 A | | 3/1977 | Lerner | 53/29 |
| 4,037,387 A | | 7/1977 | Orikawa | 53/29 |
| 4,078,358 A | | 3/1978 | Henderson | 53/29 |
| 4,086,746 A | * | 5/1978 | Christy | 53/571 |
| 4,156,334 A | * | 5/1979 | Burgat et al. | 53/385.1 |
| 4,172,349 A | * | 10/1979 | Lipes | 53/459 |
| 4,211,053 A | * | 7/1980 | Niccolls | 53/386.1 |
| 4,241,562 A | | 12/1980 | Meyer | 53/438 |
| 4,242,854 A | | 1/1981 | Nissen | 53/529 |
| 4,490,959 A | | 1/1985 | Lems | 53/459 |
| 4,541,226 A | | 9/1985 | Nausedas | 53/459 |
| 4,541,227 A | | 9/1985 | Coad et al. | 53/500 |
| 4,545,184 A | * | 10/1985 | Akiyama | 53/571 |
| 4,583,349 A | | 4/1986 | Kramming | 53/459 |
| 4,595,389 A | | 6/1986 | Lehmacher | 493/227 |

(Continued)

FOREIGN PATENT DOCUMENTS

| | | |
|---|---|---|
| EP | 0 136 171 | 4/1985 |

*Primary Examiner*—Scott A. Smith
*Assistant Examiner*—Gloria R. Weeks
(74) *Attorney, Agent, or Firm*—Michael J. Donohue; Davis Wright Tremaine LLP

(57) ABSTRACT

An apparatus and method for automatic opening of bags uses bags in a folded configuration that include a small aperture near the top thereof. The aperture allows a number of bags to be hung in a substantially vertical orientation on an angled protruding member. A vacuum-operated device engages one side of one of a first bag on the side of the bag opposite to the aperture and retracts, thus opening the bag using the force generated between the protruding member and the vacuum-operated device. This allows the bag to be opened without extraction from the protruding member. The open bag is clamped in position and loaded using conventional technology. The fully loaded bag is moved out of the loading position onto a conveyor belt. The movement of the fully loaded bag tears the back portion of the bag near the aperture thus freeing the bag from the protruding member. The loaded bag may be subsequently sealed and processed for shipping.

9 Claims, 14 Drawing Sheets

U.S. PATENT DOCUMENTS

| | | | | | |
|---|---|---|---|---|---|
| 4,651,506 | A | | 3/1987 | Lerner et al. | 53/459 |
| 4,664,161 | A | | 5/1987 | Sawa et al. | 141/114 |
| 4,676,378 | A | * | 6/1987 | Baxley et al. | 206/554 |
| 4,711,070 | A | | 12/1987 | Massa et al. | 53/573 |
| 4,715,167 | A | * | 12/1987 | Savigny | 53/572 |
| 4,729,209 | A | | 3/1988 | Owensby et al. | 53/434 |
| 4,753,060 | A | | 6/1988 | Furukawa | 53/459 |
| 4,815,255 | A | | 3/1989 | Cozzutto et al. | 53/459 |
| RE32,963 | E | | 6/1989 | Lerner et al. | 53/459 |
| 4,840,016 | A | | 6/1989 | Muller, Jr. | 53/459 |
| 4,899,520 | A | | 2/1990 | Lerner et al. | 53/459 |
| 4,947,625 | A | | 8/1990 | Zike | 53/459 |
| 4,969,314 | A | * | 11/1990 | Davis | 53/572 |
| 4,981,009 | A | | 1/1991 | Gianelli | 53/570 |
| 5,115,619 | A | | 5/1992 | Lieder | 53/459 |
| 5,177,939 | A | * | 1/1993 | Lipes | 53/572 |
| 5,249,409 | A | | 10/1993 | Jensen | 53/459 |
| 5,337,541 | A | * | 8/1994 | Gmuer | 53/459 |
| 5,442,898 | A | | 8/1995 | Gabree et al. | 53/459 |
| 5,483,784 | A | | 1/1996 | Owensby et al. | 53/459 |
| 5,499,485 | A | | 3/1996 | Lerner et al. | 53/459 |
| 5,626,004 | A | | 5/1997 | Gates et al. | 53/459 |
| 5,642,791 | A | * | 7/1997 | Zerlin et al. | 186/66 |
| 5,743,071 | A | * | 4/1998 | Wolthuizen | 53/571 |
| 5,765,338 | A | * | 6/1998 | Tsai | 53/572 |
| 5,799,465 | A | * | 9/1998 | Townsend | 53/258 |
| 5,802,817 | A | | 9/1998 | Hood | 53/459 |
| 5,813,196 | A | | 9/1998 | Pagë et al. | 53/448 |
| 5,924,573 | A | * | 7/1999 | Piraneo et al. | 206/554 |
| 5,987,854 | A | | 11/1999 | Killinger et al. | 53/459 |
| 6,094,891 | A | | 8/2000 | Savigny et al. | 53/459 |
| 6,134,864 | A | | 10/2000 | McGregor et al. | 53/459 |
| 6,171,226 | B1 | | 1/2001 | DeMatteis | 493/227 |
| 6,264,035 | B1 | | 7/2001 | Petrie | 206/554 |
| 6,325,214 | B1 | | 12/2001 | Smithson | 206/554 |
| 6,332,711 | B1 | | 12/2001 | Inuzuka et al. | 383/9 |
| 6,401,304 | B1 | | 6/2002 | Dossett | 24/16 PB |
| 6,421,984 | B1 | | 7/2002 | Murgatroyd et al. | 53/468 |
| 6,430,901 | B1 | | 8/2002 | Domansky et al. | 53/492 |
| 6,435,350 | B1 | | 8/2002 | Huang et al. | 206/554 |
| 6,435,646 | B1 | | 8/2002 | Martin et al. | 53/457 |
| 6,446,810 | B1 | | 9/2002 | Huang et al. | 206/554 |
| 6,457,298 | B1 | | 10/2002 | Schwenke et al. | 53/459 |
| 6,658,823 | B1 | * | 12/2003 | Johnsen et al. | 53/492 |
| 6,662,532 | B1 | * | 12/2003 | Droog et al. | 53/459 |

* cited by examiner

METHOD FOR AUTOMATIC BALE BAG LOADING

BACKGROUND OF THE INVENTION

1. Technical Field

The present invention is related generally to bale bag loading and, more particularly, to an apparatus and method for automatic bale bag loading.

2. Description of the Related Art

Automated processes for package loading are desirable since it decreases labor costs and increases production efficiency. For example, there are known techniques for automatically loading cartons of fruit, such as apples. As noted above, automatic loading of cartons of fruit reduces labor costs and thus the cost of the finished product. In addition, production efficiency is greatly increased by such automated processing.

Despite the desirability of automated processing, not all processes have been automated. In one example, prepackaged bags of products, such as potatoes, are placed in a large shipping bag called a bale. In one example, a bale contains five individual 10 lb. bags of potatoes. Previous attempts to automate the bale loading process have been unsuccessful. Therefore, it can be appreciated that there is a significant need for an automatic process for loading bales. The present invention provides this and other advantages as will be apparent from the following detailed description and accompanying figures.

BRIEF SUMMARY OF THE INVENTION

The present invention is embodied in an apparatus and method for bale bag loading. The apparatus is for use with bags having an aperture in a top portion on one side thereof. The apparatus comprises a protruding member sized to fit through the aperture in the bags and thereby retain the bags in a substantially vertical orientation. An engagement member has an operating surface to engage a first one of the bags on a first side of the bag opposite the side of the bag having the aperture. The engagement member retracts to a second position such that the side of the bag having the aperture is still retained on the protruding member to thereby open the first bag.

In one embodiment, the engagement member is a vacuum-operated device to engage the first side of the first bag. If the bag is a paper bag, the vacuum-operated device is operated with a predetermined vacuum level to engage a first run of the bags on the first side of the bag. In an alternative embodiment, the bag is a plastic bag, and the vacuum-operated device is operated with a predetermined vacuum level to engage a first run of the bags on the first side of the plastic bag.

In yet another alternative embodiment, the engagement member comprises an air source to direct an air stream at the first side of the bag to at least partially open the bag in a mechanical finger assembly operating to engage the first side of the first bag subsequent to the at least partial opening.

The system may further comprise a retaining member to engage and retain the first bag during a loading operation. The retaining member may be positioned to engage and retain the left and right side portions of the first bag during the loading operation.

The system may further comprise a loading chute located in proximity with the first bag when the vacuum-operated device is in the second position to permit products to be loaded into the first bag.

BRIEF DESCRIPTION OF THE SEVERAL VIEWS OF THE DRAWING(S)

DETAILED DESCRIPTION OF THE INVENTION

Figure 1:
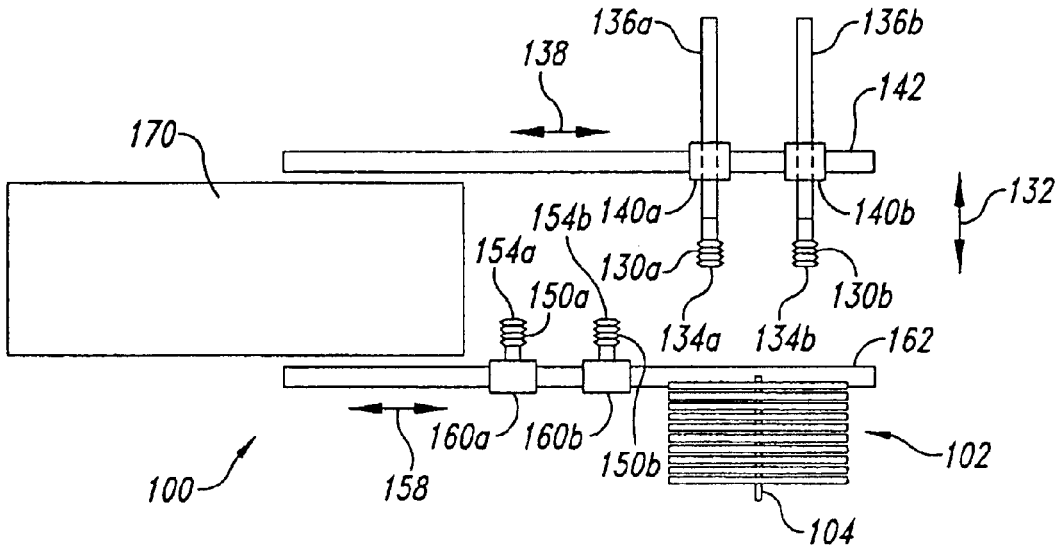
FIG. 1 is a top plan view of the inventive apparatus.

The present invention is directed to a technique that automatically extracts a bag, such as a bale bag, opens the bag, and positions the bag for loading. The present invention is embodied in a system 100 illustrated in the top plan view of FIG. 1. As illustrated in FIG. 1, a plurality of bags 102 are placed on a protruding member 104. In one embodiment, the protruding member 104 is a rod mounted at an upwardly projecting angle, as illustrated in FIG. 2, to permit gravity feeding of the bags 102.

Figure 2:
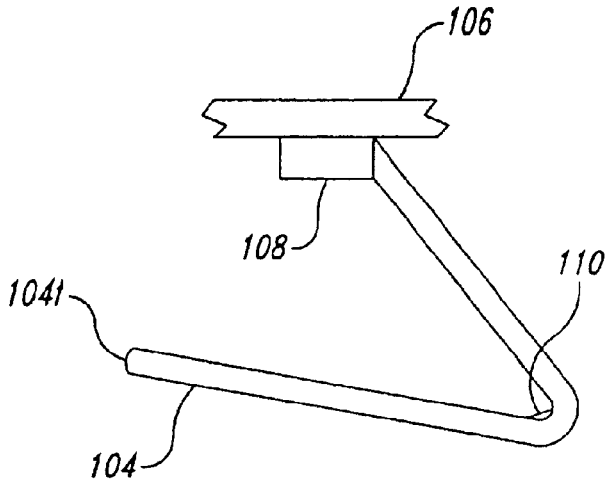
FIG. 2 is a side view illustrating details of the inventive apparatus.

FIG. 2 is a side elevational view of the protruding member 104 illustrating its attachment to a frame 106 by a mounting bracket 108. The mounting bracket 108 may be attached to the frame 106 using screws, nuts and bolts, rivets, or other known mechanical attachment components. Those skilled in the art will recognize that the protruding member 104 may be directly mounted to the frame 106 using well-known conventional techniques, such as welding, adhesives, or the like. The protruding member 104 may have a rounded terminal portion 104*t* to minimize the potential to damage to the aperture 124 when loading the bags 102 onto the protruding member. The rounded terminal portion 104*t* also makes it easier to place the bags 102 on the protruding member 104.

A cutting blade 110 is mounted at the lowest portion of the protruding member 104. The cutting blade 110 may be a razor blade, knife blade, or other known device. In one embodiment, the cutting blade 110 may be mounted in a slot (not shown) in the protruding member 104. The cutting blade 110 may be retained within the slot using conventional means, such as a set-screw, adhesive, or the like. As will be described in greater detail below, the cutting blade 110 is used to extract a bag 102 from the protruding member 104.

In one embodiment, the protruding member 104 is formed from a circular rod. The bag 102 is similar to a conventional bale bag, but is modified for use with the automatic system of the present invention. The bag 102 may be formed from one or more layers of brown paper. The bag 102 is illustrated in a folded or closed configuration in FIG. 3. The bags 102 are folded in the manner of a conventional grocery bag to permit ease in shipping and storage. The bag 102 is shown in an unfolded or open configuration in FIG. 4. In the folded configuration, the dimensions of the bag 102 are approximately 13 inches wide by 32 inches long. When in the unfolded configuration, shown in FIG. 4, the bag has a depth of approximately 7 inches and an opening of approximately 7 inches by 13 inches. Although the bag 102 may have the standard dimensions described above, those skilled in the art will recognize that the system 100 can be used with bags of virtually any dimension. The only accommodation for bags of different size may be the relative location of the various components of the system 100.

Figure 3:
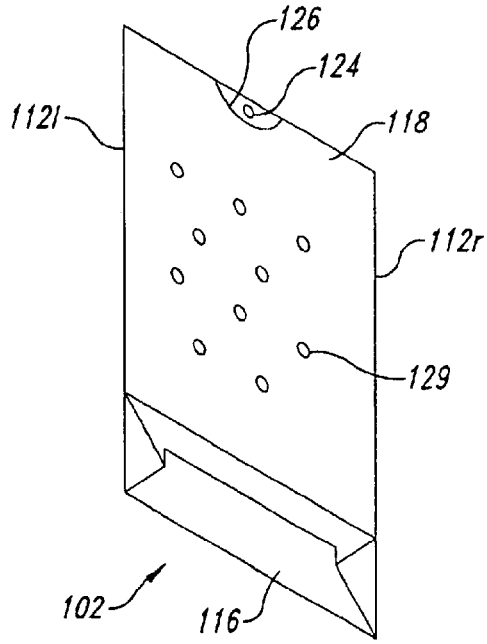
FIG. 3 is a perspective view of a bale bag used with the inventive apparatus.
Figure 5:
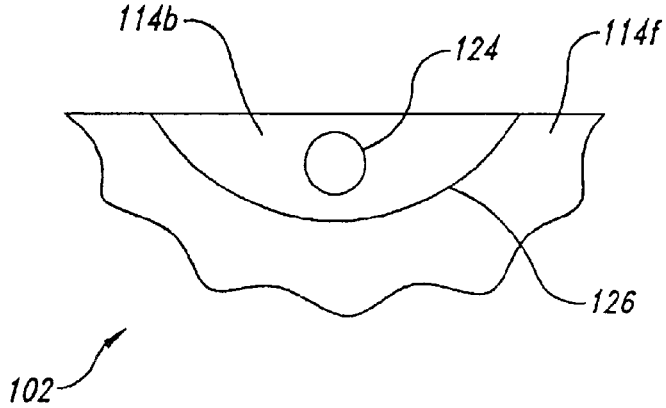
FIG. 5 is a partial enlarged front elevation view of the bag of FIG. 3.
Figure 6:
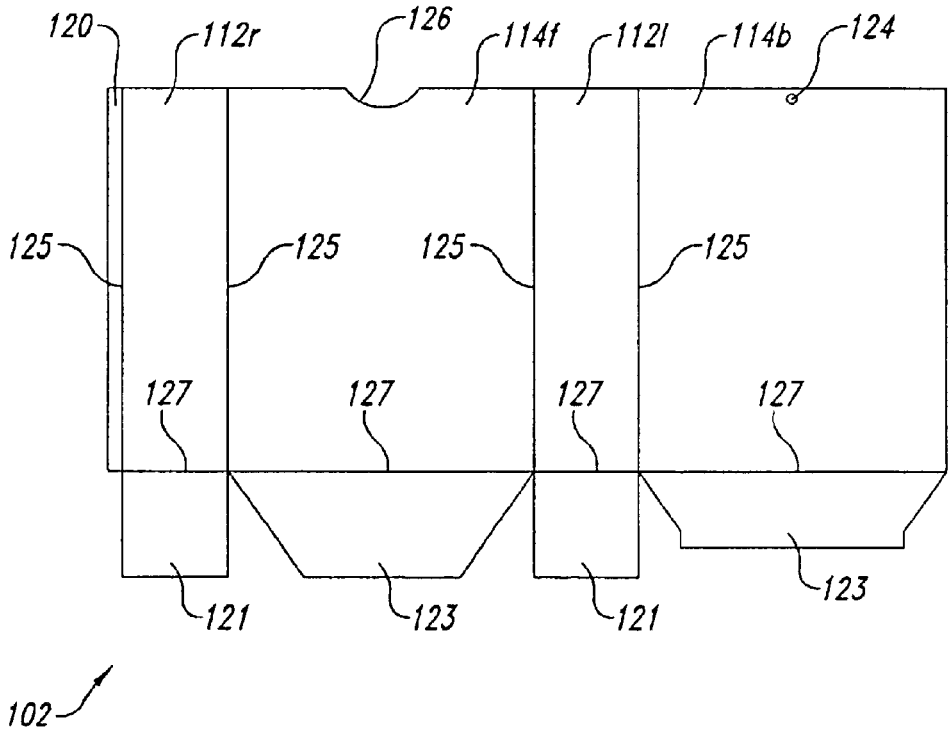
FIG. 6 is a top plan view illustrating the manufacture of the bag of FIG. 3.

The bag 102 may be manufactured from a single large piece of paper, illustrated in FIG. 5, that is cut, folded into several panels or portions, and glued in a conventional manner. The bag 102 has left and right side portions 112*l* and 112*r*, respectively. The bag 102 also includes front and back portions 114*f* and 114*b*, respectively. A strip 120 projects from the right side portion 112*r*. The strip 120 is glued to the back portion 114*b* when the bag 102 is formed. The left and right side portions 112*l* and 112*r* have flaps 121, which are used to seal the bottom of the bag 102. Similarly, the front and back portions 114*f* and 114*b* have flaps 123 that are also used to seal and form a bottom portion 116, as illustrated in FIG. 3.

Once the bag 102 has been cut from stock material, it may be folded along fold lines 125 to form the front and back portions 114*f* and 114*b* and left and right side portions 112*l* and 112*r*. The strip 120 may be glued to the back portion 114*b* to seal the various portions. The bag also includes fold lines 127. The flaps 121 and 123 are folded at the fold lines 127 to form the bottom portion 116. The flaps 121 from the left and right side portions 112*l* and 112*r* are folded. The flap 123 from the front portion 114*f* is folded and glued to the flaps 121. Finally, the flap 123 from the back portion 114*b* is folded and glued to the flap 123 from the front portion 114*f* to seal the bottom portion 116 of the bag 102. In this manner, the bag 102 may be manufactured.

Figure 4:
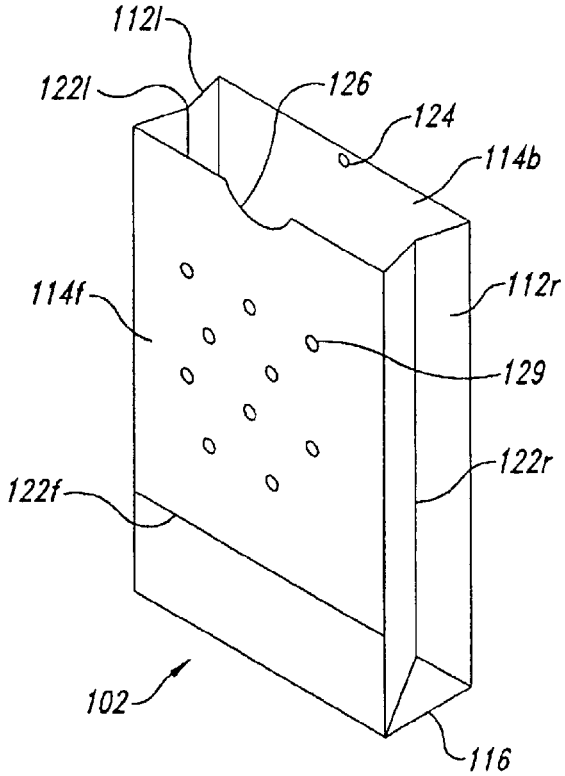
FIG. 4 illustrates the bag of FIG. 3 in an open configuration.

The bag 102 may be formed with creases to assist in folding the bag following manufacture., As illustrated in FIG. 4, the bag 102 may include a front crease 122*f* on the front portion 114*f* extending from the left side portion 112*l* to the right side portion 112*r* near the bottom 116 of the bag. The precise location of the crease 122*f* is typically dependent on the dimensions of the bag. For example, the crease 122*f* may be located at a distance from the bottom portion 116 that is approximately one-half of the distance between the front portion 114*f* and the back portion 114*b* when the bag is in the open configuration. In addition, the bag 102 may include creases 122*l* and 122*r* on the left and right side portions 112*l* and 112*r*, respectively. The crease 122*l* and 122*r* are located approximately midway between the front portion 114*f* and the back 114*b* when the bag is in the open configuration. The creases 122*l* and 122*r* extend from the top portion 118 to a point near the bottom portion 116. The creases 122*l* and 122*r* extend to a point approximately equal to the location of the crease 122*f* to facilitate folding of the bag 102. From the terminating point of the creases 122*l* and 122*r*, additional creases extend from the midline of the side portions 112*l* and 112*r* to the junctions of the side portions 112*l* and 112*r* with the front and back portions 114*f* and 114*b* near the bottom portion 116 of the bag 102.

The bag 102 also includes an aperture 124 in the top portion 118 of the back portion 114*b*. In an exemplary embodiment, the aperture 124 is approximately 0.625 inches in diameter and is located a short distance from the top of the back portion 114*b*. For example, the aperture 124 may be spaced apart from the top of the back portion 114*b* by approximately 0.25 inches. The short separation between the aperture 124 and the top of the back portion 114*b* of the bag 102 permits the easy extraction of the bag from the protruding member 104. In one embodiment, the bag 102 may be removed from the protruding 104 simply by tearing the back portion 114*b* at the point of narrow separation between the back portion and the aperture 124. The cutting blade 110 (see FIG. 2) may be used to slice the back portion 114*b* at the aperture 124 thus preventing an undesirable tear. Alternatively, the bag 102 may include a perforated portion above the aperture to control the tearing. In this embodiment, the cutting blade 110 can be eliminated.

In the embodiment illustrated in FIGS. 3–5, the aperture 124 is circular in shape to match the cylindrical shape of the protruding member 104. The cylindrical shape of the protruding member 104 and the circular aperture 124 permit easy loading of bags 102 onto the protruding aperture. In addition, the bags 102 slide easily down the cylindrical protruding member 104.

Those skilled in the art will appreciate that the protruding member 104 may have different shapes and that the aperture 124 may be circular or may have a shape that corresponds to the selected shape for the protruding member. For example, the protruding member 104 may have a semi-circular shape with a rounded portion on top and a flat portion on the bottom. The bags 102 may still have the circular aperture 124, as illustrated in FIGS. 3–5, or may have a shape selected to correspond to the shape of the protruding member 104. Other shapes, such as triangular, rectangular, or the like may also be used satisfactorily with the system 100. The present invention is not limited by the specific geometric form of the protruding member 104 or the aperture 124.

FIG. 5 is a fragmentary front elevational view of the bag 102 illustrating the location of the aperture 124 in the back portion 114*b* of the bag. A curve cutout 126 in the front portion 114*f* of the bag 102 more fully exposes the aperture 124 in the back portion 114*b* and allows easy insertion of the protruding member 104 through the aperture when loading the bags. The bag 102 may also have a series of ventilation holes 129 in the front and back portions 114*f* and 114*b* to allow ventilation of the packaged produce.

Returning again to FIG. 1, the system 100 also includes a set vacuum-operated suction devices 130*a* and 130*b* to engage and extract a first bag 102 from the protruding member 104. The bags 102 are extracted from the protruding member 104 in the same sequence in which they are placed on the protruding member (i.e., first on-first off). As illustrated in FIG. 1, the vacuum-operated devices 130*a–b* have a terminal vacuum-operated suction cup 134*a* and 134*b*, respectively. As the vacuum-operated devices 130*a–b* make contact with the bag 102, the bag is retained by virtue of the vacuum-operated suction cups 134*a–b*. The vacuum-operated devices 130*a–b* are mounted on air cylinder slides 136*a* and 136*b*, respectively. The air cylinder slides 136*b* move in a direction indicated by a reference arrow 132 to allow the suction cups 134*a–b* to engage a first of the bags 102 on the protruding member 104. The vacuum-operated devices 130*a–b* may be positioned to engage the bag 102 at any desirable position. In an exemplary embodiment, the suction cups 134*a–b* engage a first side of the bag 102 on the back portion 114*b* (see FIG. 4) near the top portion 118 at a distance of approximately 1.5–2 inches in from the left and right sides 112*l* and 112*r*, respectively.

The vacuum-operated devices 130*a–b* generate sufficient vacuum to engage a bag on the protruding member 104, extract the bag and support the weight of the bag. The precise vacuum level is not critical, but must be sufficiently strong to perform the tasks outlined above. A vacuum may be readily generated using Venturi devices in which air is passed over the open end of a tube in order to create a suction at a distal end of the tube. In the system 100, the vacuum-operated devices 130*a–b* are commercial products available from Vaccon Vacuum Generator.

In the embodiment illustrated in FIG. 1, a pair of vacuum-operated devices 130*a–b* are used to support the bag 102. The use of dual vacuum-operated devices provides greater stability and relatively uniform extraction pressure on the bag 102 on both sides of protruding member 104 such that the bag is drawn smoothly against the cutting blade 110. Additional vacuum-operated devices may be used to provide additional stability or if the size of the bag 102 warrants extra support. However, if the bag 102 is relatively small, a single vacuum-operated device may be sufficient to extract the bag from the protruding member 104. Thus, the system 100 is not limited by the number or specific layout of the vacuum-operated devices used to extract the bag 102 from the protruding member 104.

In operation, the air cylinder slides 136*a–b* and the vacuum-operated devices 130*a–b* move in the direction indicated by the reference arrow 132 to engage the bag 102 on the protruding member 104. Upon contact with the bag 102, the suction cups 134*a–b* engage a first side of the bag (ie., the back portion 114*b*) and retain the bag. As the air cylinder slides 136*a–b* and the vacuum-operated devices 130*a–b* move away from the protruding member 104 in the direction indicated by the reference arrow 132, a single bag 102 is extracted from the protruding member and held in position by virtue of the suction cups 134*a–b*. Thus, the system 100 is capable of automatically extracting a single bag 102 from the protruding member 104. As the vacuum-operated device 130 moves away from the protruding member in the direction indicated by the reference arrow 132, the cutting blade 110 slices through a portion of the bag 102 to allow its easy removal from the protruding member.

The use of air cylinder slides, such as the air cylinder slides 136*a–b* is well known in the art and need not be described in greater detail herein. Alternatively, the vacuum devices 130*a–b* may be moved back and forth in the direction indicated by the reference arrow 132 through other known techniques, such as stepper motors, servo motors, drive chains, belts, or the like. The system 100 is not limited by the specific technique used to move the vacuum-operated devices 130*a–b* in the direction indicated by the reference arrow 132.

In addition to movement in the direction indicated by the reference arrow 132, the vacuum-operated devices 130*a–b* are capable of moving in the direction indicated by a reference arrow 138. To permit this movement, the vacuum-operated devices 130*a–b* are coupled to respective support brackets 140*a* and 140*b*. In turn, the support brackets 140*a–b* are slidably coupled to a support member 142. Movement of the support brackets 140*a–b* and thus the vacuum-operated devices 130*a–b* in the direction indicated by the reference arrow 138 is controlled by a stepper motor (not shown). In an exemplary embodiment, the vacuum-operated devices 130*a* and 130*b* move in unison in the direction indicated by the reference arrow 138. The vacuum-operated devices 130*a–b* may be locked together and controlled by a single stepper motor. Alternatively, the vacuum-operated devices 130*a* and 130*b* may be independent with the position of each of the vacuum-operated devices being controlled by individual stepper motors.

The positioning of the vacuum-operated devices 130*a–b* can be precisely controlled with stepper motors. Signals to control the operation of the stepper motors are generated by a conventional computer (not shown), such as a personal computer (PC), a single board microcomputer, microcontroller, or the like. Displacement of the vacuum-operated devices 130*a–b* is precisely controlled by the number of pulses provided to the stepper motor. Alternatively, the stepper motor may be replaced by other conventional drive means, such as air cylinder slides, servo motors, chain drives, belt drives, screw drives, and the like. Drive mechanisms, such as chain drives, may use position sensing microswitches (not shown) to control movement of the vacuum-operated devices 130*a–b* in the direction indicated by the reference arrow 138. Use of such position sensing devices are well known in the art and need not be described in greater detail herein.

The system 100 has a second pair of vacuum-operated devices 150*a* and 150*b* that are positioned in opposition to the vacuum-operated devices 130*a–b*. A suction cup 154*a* and 154*b* is mounted at the terminal end of the vacuum-operated devices 150*a–b*, respectively. As will be described in detail below, the vacuum-operated devices 150*a–b* engage a bag 102 that has been previously been extracted by the vacuum-operated devices 130*a–b*. As previously described, the vacuum-operated devices 130*a–b* move in the direction indicated by the reference 132 until the suction cups 134*a–b* engage a single bag 102 on a first side of the bag (i.e., the back portion 114*b*). The vacuum may be activated as the air cylinder slides 136*a–b* are activated such that a vacuum is established before the suctions cups 134*a–b* make contact with the bag 102. Alternatively, the vacuum can be established as the suction cups 134*a–b* approach the bag 102. The vacuum is activated such that the suction cups 134*a–b* engage the first side of the bag 102. As the vacuum-operated devices 130*a–b* move away from the bags 102 in the direction indicated by the reference arrow 132, a single bag is extracted from the protruding member 104.

Following extraction of a single bag, the vacuum-operated devices 130*a–b* move in a direction indicated by the reference arrow 138 until the vacuum-operated devices are substantially aligned with the vacuum-operated devices 150*a–b*. The vacuum-operated devices 130*a–b* move in the direction indicated by the reference arrow 132 toward the vacuum-operated devices 150*a–b* until the suction cups 154*a–b* engage the second side of the bag 102 (ie., the front portion 114*f*) opposite the vacuum-operated devices 130*a–b*. The vacuum-operated devices 150*a–b* are positioned to engage the front portion 114*f* of the bag 102 on the opposite side of the bag from the vacuum-operated devices 130*a–b*.

When the suction cups 154*a–b* have engaged the second side of the back of the extracted bag 102, the vacuum may be activated and the vacuum-operated devices 130*a–b* moved in a direction indicated by the reference arrow 132 away from the vacuum-operated devices 150*a–b* to thereby unfold the bag. Alternatively, the vacuum for the vacuum-operated devices 150*a–b* may be activated as the extracted bag 102 approaches. The precise moment of activation of the vacuum-operated devices 150*a–b* is not critical to satisfactory operation of the system 100.

It should be noted that the vacuum-operated devices 150*a–b* are not mounted on air cylinder slides, such as the air cylinder slides 136*a–b* used to move the vacuum-operated devices 130*a–b* in the direction indicated by the reference arrow 132. The construction and operation of the system 100 are simplified by fixing the position of the vacuum-operated devices 150*a–b* so that no movement occurs in the direction indicated by the reference arrow 132. Such an arrangement simplifies the system 100 by eliminating need for air cylinder slides and the associated measurement and control circuitry. However, if the system 100 is installed in a location that limits the movement of the vacuum-operated devices 130*a–b* in the direction indicated by the reference arrow 132, it is possible to mount the vacuum-operated devices 150*a–b* on air cylinder slides to permit movement in the direction indicated by the reference arrow 132. In this embodiment, both sets of vacuum-operated devices (i.e., the vacuum-operated devices 130*a–b* and 150*a–b*) are positioned on air cylinder slides (e.g., the air cylinder slides 136*a–b*).

The vacuum-operated devices 150*a–b* are also capable of movement in a second direction indicated by the reference arrow 158. The vacuum-operated devices 150*a–b* are coupled to support brackets 160*a* and 160*b*. The support brackets 160*a–b* are slidably connected to a support member 162 to permit movement in the direction indicated by the reference arrow 158. Movement of the vacuum-operated devices 150*a–b* in the direction indicated by the reference arrow 158 is controlled by stepper motors. As discussed above with respect to the vacuum-operated devices 130*a–b*, a single stepper motor may be sufficient to move both vacuum-operated devices 150*a–b*. In this embodiment, the vacuum-operated devices 150*a–b* are coupled together for movement controlled by the single stepper motor. Alternatively, a stepper motor may be associated with each of the vacuum-operated devices 150*a* and 150*b*. Alternatively, the movement of the vacuum-operated devices 150*a–b* in the direction indicated by the reference arrow 158 may be controlled by other conventional techniques, such as servo motors, air cylinder slides, chain drive, belt drive, screw drive, and the like. The present invention is not limited by the specific form of the drive mechanism used to control movement of the vacuum-operated devices 150*a–b* in the direction indicated by the reference arrow 158.

Following engagement of the front and back portions 114*f* and 114*b* of the bag 102, the vacuum-operated devices 130*a–b* and the vacuum-operated devices 150*a–b* move in synchronization in the direction indicated by the reference arrows 138 and 158, respectively. In this manner, the extracted and opened bag 102 is moved into position at a conveyor belt 170 where the bag may be loaded. Conventional devices are used to automatically load the opened bag 102. A set of clamps (not shown) attached to the top of the side portions 122*l* and 122*r* stabilize and retain the bag 102 while it is being loaded. As the product (e.g., individual bags of potatoes) are loaded into the opened bag 102, the bottom 116 of the bag rests on the conveyor belt 170. After the products have been loaded into the bag 102, the side clamps (not shown) release and the conveyer belt 170 is activated to move the loaded bag 102 out of the loading area.

It should be noted that the sequence of opening the bag and moving the bag to the conveyor belt 170 may be performed interchangeably. That is, the extracted bag 102 may be unfolded and subsequently moved to the conveyor belt 170, as described above. Alternatively, the extracted bag 102 may be moved to the conveyor belt 170 while still in the folded configuration (see FIG. 3). The bag 102 may be subsequently opened into the unfolded configuration (see FIG. 4) after arrival at the conveyor belt 170. Thus, the present invention is not limited by the specific sequence of these two events.

Figure 7:
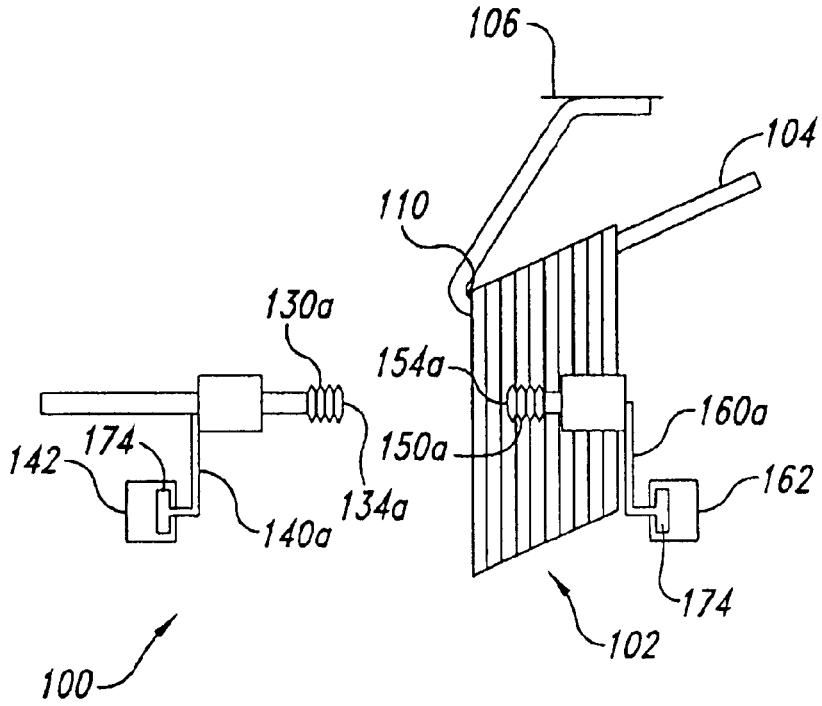
FIG. 7 is a side view of the inventive apparatus.

FIG. 7 is a side view of the system 100. As best seen in FIG. 7, the vacuum-operated devices 130*a–b* and 150*a–b* are mounted at approximately the same height, but facing towards each other. As previously discussed, the vacuum-operated devices 130*a–b* and 150*a–b* are coupled to support members 142 and 162, respectively, by respective support brackets 140 and 160. In the exemplary embodiment illustrated in FIG. 7, the support members 142 and 162 are rectangular supports that may conveniently be manufactured from aluminum or other conventional materials. As can be seen from FIG. 7, the support members 142 and 162 each contain a channel 174. The mounting bracket 140 is inserted in the channel 174 of the support member 142 such that the vacuum-operated devices 130*a–b* may move smoothly along the channel in a direction indicated by the reference arrow 138 (see FIG. 1). Similarly, the support bracket 160 is inserted into the channel 174 of the support member 162 to permit the vacuum-operated devices 150*a–b* to move easily along the channel in the direction indicated by the reference arrow 158 (see FIG. 1).

Figure 8:
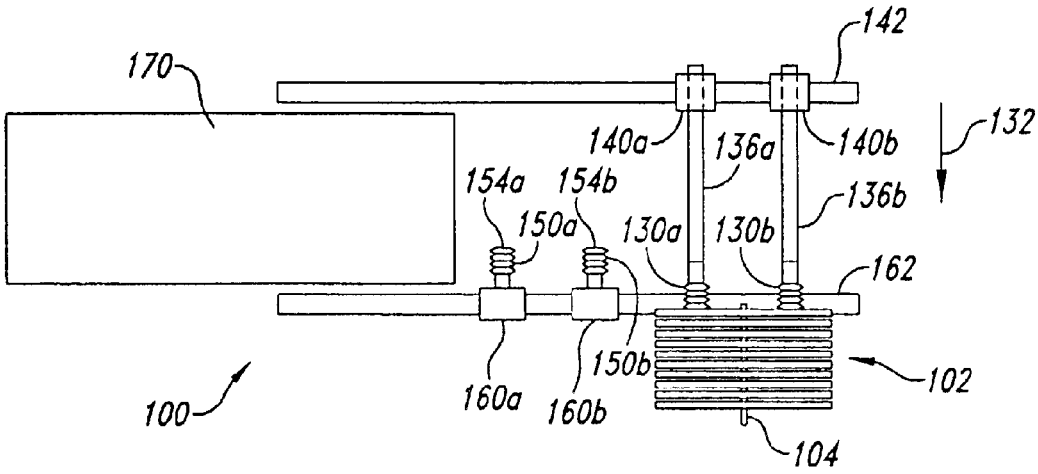
FIG. 8 is a top plan view illustrating the apparatus in operation.

FIGS. 7–12 are top plan views of the system 100 illustrating the positioning of the vacuum-operated devices 130*a–b* and 150*a–b* at different stages of the process. In FIG. 8, the vacuum-operated devices 130*a–b* advance in the direction indicated by the reference arrow 132 until the suction cups 134*a–b* make contact with the first bag 102 on the protruding member 104. It should be noted that the vacuum device may be continuously activated at-this step or may be activated at any point before contacting the bag 102 or at the time of contact of the bag. When the vacuum is activated, the suction cups 134*a–b* engage and retain the first bag 102 on the protruding member 104.

Figure 9:
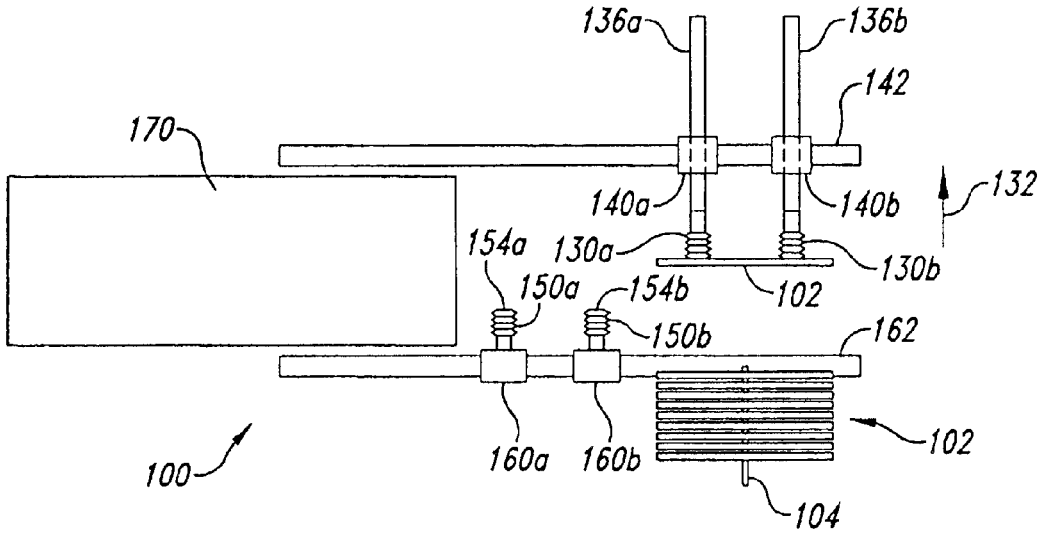
FIG. 9 is a top plan view illustrating the extraction of a bale bag.

In FIG. 9, the vacuum-operated devices 130*a–b* move in the direction indicated by the reference arrow 132 away from the protruding member 104. Because the first bag 102 is held in engagement with the suction cups 134*a–b* by virtue of the vacuum, the first bag is extracted from the protruding member 104. As noted above, the small section of the bag 102 above the aperture 124 (see FIG. 5) is torn by the process of removal from the protruding member 104. The cutting blade 110 (see FIG. 2) may be used to control the extraction process by initiating the cut in the paper just above the aperture 124. In yet another alternative embodiment, the section of the bag 102 just above the aperture 124 may be perforated to control the tearing process as the first bag is extracted from the protruding member 104.

Figure 10:
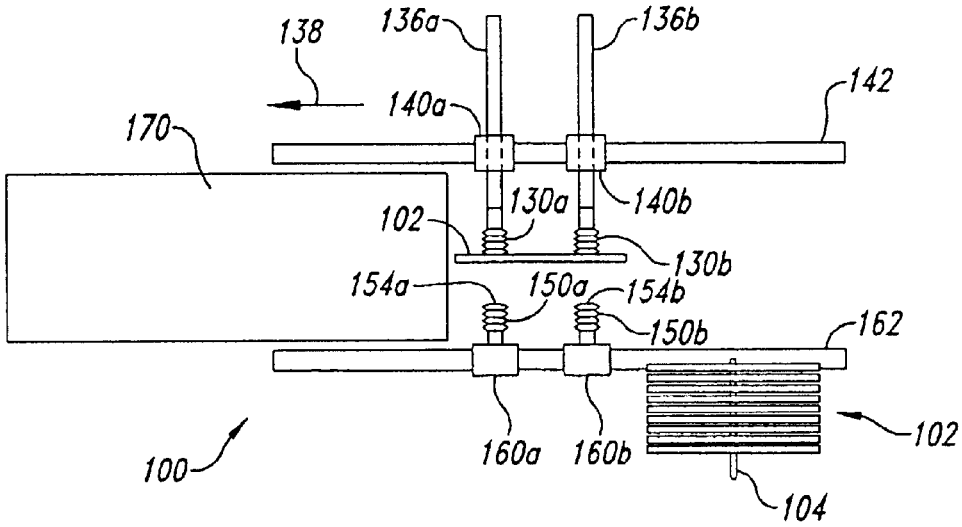
FIG. 10 is a top plan view illustrating linear displacement of the extracted bag.

FIG. 9 illustrates the position of the vacuum-operated devices 130*a–b* following the extraction of the first bag 102 from the protruding member 104. At this point, the extracted bag 102 is still in the folded configuration (see FIG. 3). In FIG. 10, the vacuum-operated devices 130*a–b* are displaced in the direction indicated by the reference arrow 138 until the vacuum-operated devices are substantially aligned with the vacuum-operated devices 150*a–b*.

Figure 11:
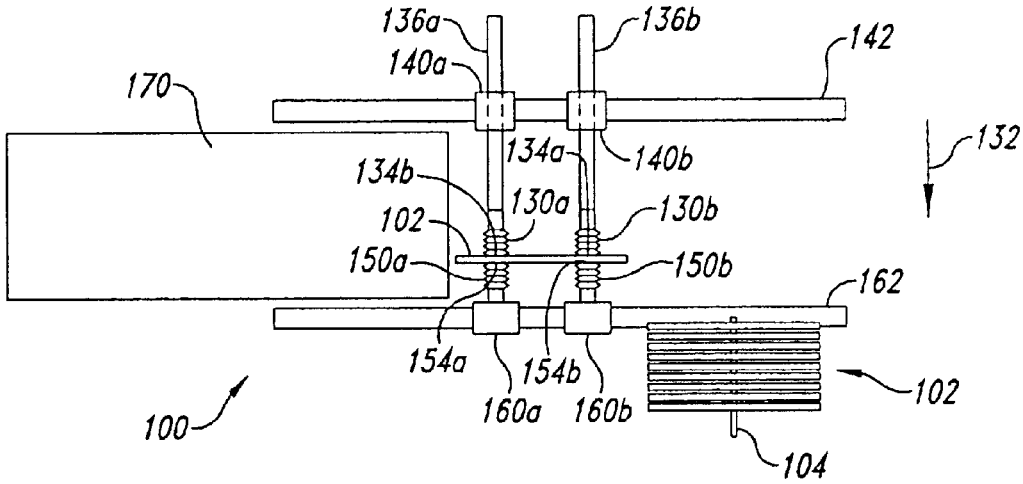
FIG. 11 is a top plan view illustrating the engagement of the extracted bag to open the bag.

In FIG. 11, the air cylinder slides 136*a* and 136*b* are activated to move the vacuum-operated devices 130*a–b* in the direction indicated by the reference arrow 132 until the suction cups 154*a–b* make contact with the second side of the extracted bag 102. It should be noted that the vacuum-operated devices 130*a–b* are still activated such that the first side (ie., the back portion 114*b*) of extracted bag 102 is held in position by the suction cups 134*a–b*. When the vacuum-operated devices 150*a–b* are activated, the suction cups 154*a–b* engage and retain the second side (i.e., the front portion 114*f*) of the extracted bag 102. As noted above with respect to the vacuum-operated devices 130*a–b*, the vacuum-operated devices 150*a–b* may be activated as the vacuum-operated devices 130*a–b* approach with the extracted bag 102 or after the suction cups 154*a–b* make contact with the second side (i.e., the front portion 114*f*) of the extracted bag.

Figure 12:
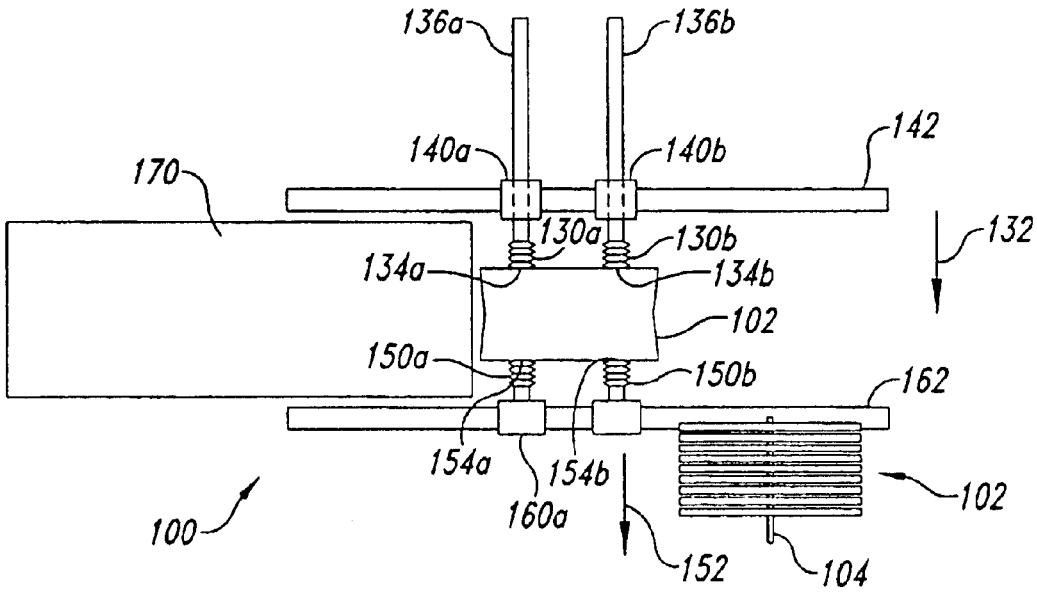
FIG. 12 is a top plan view illustrating the activation of the apparatus to open the extracted bag.

In FIG. 12, the air cylinder slides 136*a–b* withdraw away from the vacuum-operated devices 150*a–b* in the direction indicated by the reference arrow 32. As the vacuum-operated devices 130*a–b* move away from the vacuum-operated devices 150*a–b*, the extracted bag 102 is opened into the unfolded configuration (see FIG. 4). The bag 102 may be opened by moving one or both of the vacuum-operated devices 130*a–b* and 150*a–b* away from each other. In an exemplary embodiment, the vacuum-operated devices 150*a–b* are held in a constant position while only the vacuum-operated devices 130*a–b* move in the direction indicated by the reference arrow 132 away from the vacuum-operated devices 150*a–b*. This process places the extracted bag 102 in the unfolded configuration.

Alternatively, the vacuum-operated devices 150*a–b* also move in the direction indicated by a reference arrow 152 away from the vacuum-operated devices 130*a–b*. If both vacuum-operated devices 130*a–b* and 150*a–b* move approximately the same distance, the extracted bag 102 is placed in the unfolded configuration (see FIG. 4) approximately centered between the support members 142 and 162. In yet another alternative, the vacuum-operated devices 130*a–b* may be held in a constant position while the vacuum-operated devices 150*a–b* move in a direction indicated by the reference arrow 152 away from the vacuum-operated device 130. In any of these combinations of movement, the extracted bag 102 is placed in the unfolded configuration.

Figure 13:
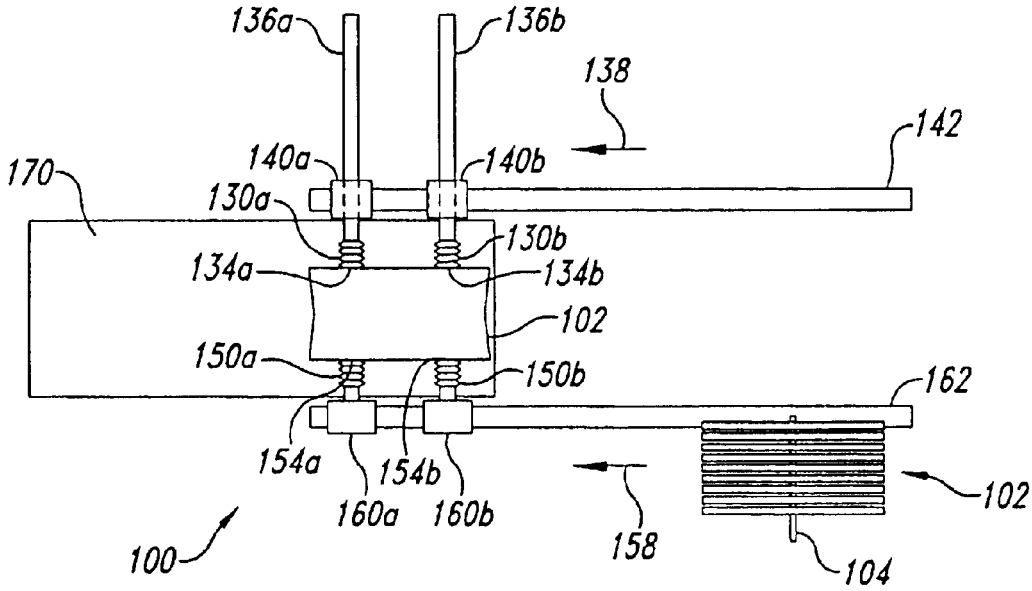
FIG. 13 is a top plan view of the inventive apparatus illustrating linear displacement of the extracted opened bag into a loading area.
Figure 14:
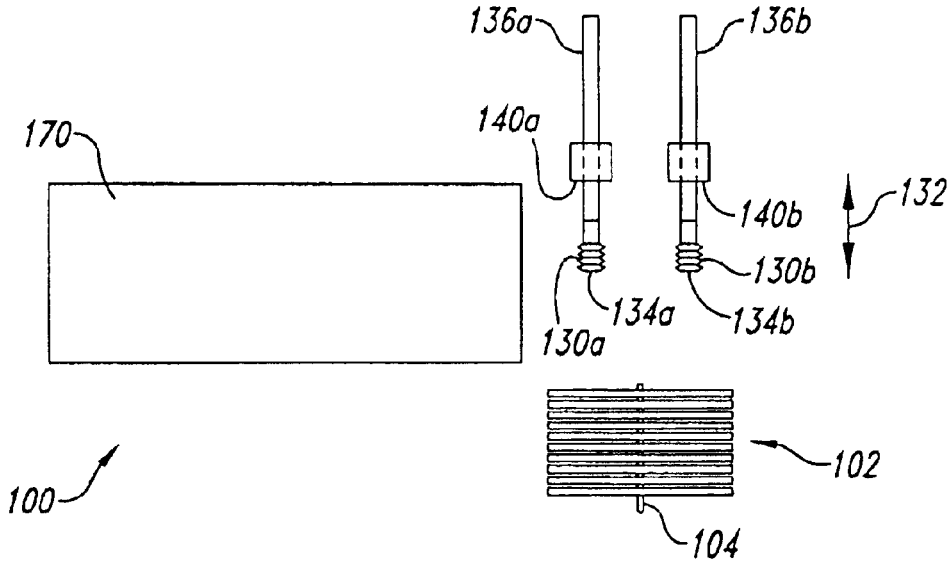
FIG. 14 is a top plan view of an alternative embodiment.

The extracted and unfolded bag 102 is moved into position atop the conveyor belt 170, as shown in FIG. 13. This movement is accomplished by synchronized movement of the vacuum-operated devices 130*a–b* and the vacuum-operated devices 150*a–b*. Specifically, the vacuum-operated devices 130*a–b* move in a direction indicated by the reference arrow 138 toward the conveyor belt 170 at a predetermined rate of movement. At the same time, the vacuum-operated devices 150*a–b* move in a direction indicated by the reference arrow 158 toward the conveyor belt 170 at the same predetermined rate thus maintaining the position of the suction cups 134*a–b* and 154*a–b* with respect to the extracted and unfolded bag 102. While at the conveyor belt 170, the unfolded bag 102 is filled in a conventional manner. As previously discussed, a clamping mechanism (not shown) clamps the open bag in position on the conveyor belt 170 to permit loading. The open bag 102 is automatically loaded with prepackaged bags of produce using a conventional automatic loading machine (not shown).

Once the clamps (not shown) have been activated to secure the open bag 102, the process of extracting a new bag may be repeated. That is, the vacuum is deactivated so that the vacuum-operated devices 130*a–b* and 150*a–b* no longer support the open bag 102. The vacuum-operated devices 150*a–b* return to their original starting position. The air cylinder slides 136*a–b* retract and the vacuum-operated devices 130*a–b* are returned to their original position. The entire process is repeated to automatically extract the next bag 102 from the protruding member 104.

Thus, the system 100 automatically extracts a single bag from the protruding member 104, opens the extracted bag to an unfolded configuration, and moves the extracted open bag into position on the conveyor belt 170. As previously noted, it is possible to move the extracted bag 102 into position above the conveyor belt 170 before opening the bag. That is, the process of opening the extracted bag 102 into the unfolded configuration (see FIG. 4) may be performed in the sequence illustrated in FIGS. 11 and 12 or the process may be reversed such that the unopened extracted bag 102 is first moved to the conveyor belt 170 and opened into the unfolded configuration. In either event, the process of extracting bags is automated by the system 100 thus reducing labor costs and increase efficiency. In an exemplary embodiment, the protruding member 104 is sufficiently long to hold a large number (e.g., 50) of bags 102.

In an alternative embodiment, illustrated in FIGS. 14–20, the system 100 utilizes only a single set of vacuum-operated devices 130*a–b* to open the bag 102. In this embodiment, the system 100 relies on the protruding member 104 to retain contact with one side of the bag 102. In the previous embodiment, the bags 102 are inserted onto the protruding member 104 with the back portion 114*b* facing toward the vacuum-operated devices 130*a–b*. As the vacuum-operated devices 103*a–b* engage the first side of the bag 102 (i.e., the back portion 114*b*), the bag is drawn against the cutting blade 110 to completely extract the bag 102 from the protruding member 104, as illustrated in FIG. 9.

Figure 15:
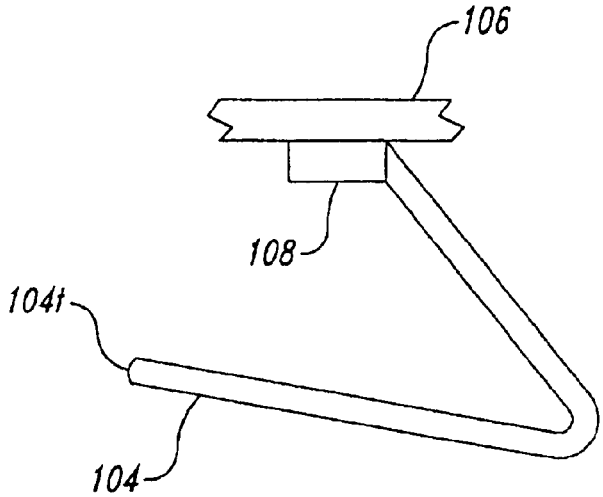
FIG. 15 is a side view illustrating details of the alternative embodiment.

In contrast, the alternative embodiment illustrated in FIGS. 14–20 does not utilize the cutting blade 110 on the protruding member 104. A side view of the protruding member 104 is illustrated in FIG. 15. Furthermore, the bags 102 are mounted on the protruding member 104 such that the front portion 114*f* of the bag faces toward the vacuum-operated devices 130*a–b*.

Figure 16:
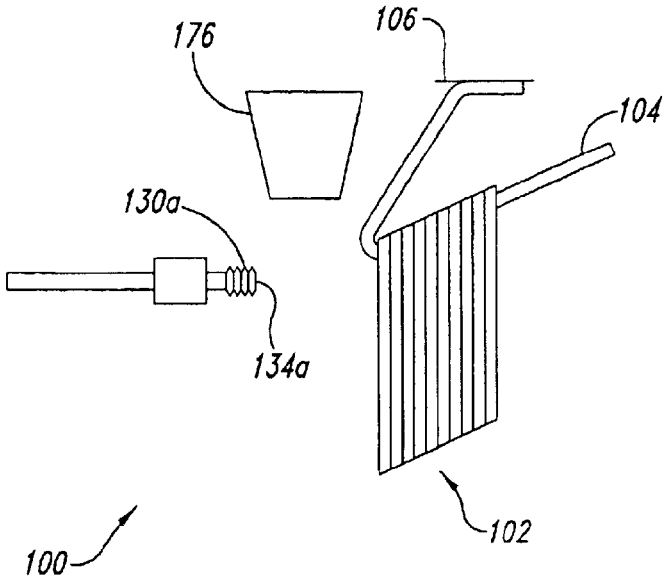
FIG. 16 is a side view illustrating the alternative embodiment.
Figure 17:
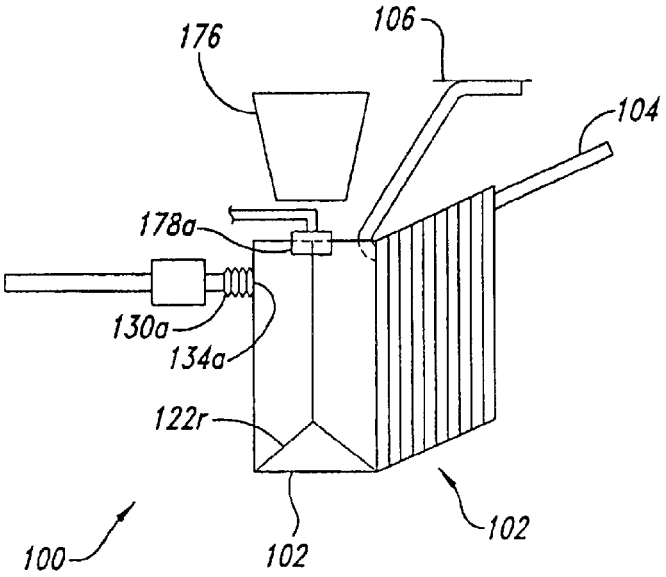
FIG. 17 is a side view of the embodiment of FIG. 16 illustrating an open bale bag.

In the alternative embodiment of FIGS. 14–20, the open bag 102 is loaded with product (e.g., pre-packaged bags of produce) using a conventional automatic loading machine. FIG. 16 is a side view illustrating a funnel or chute 176, which is positioned above the bags 102. FIG. 17 is another side view illustrating an open bag 102, which is opened by the vacuum-operated devices 134*a–b* acting on one side of the bag 102, (i.e., the front portion 114f, shown in FIGS. 34) and the protruding member 104 acting on the opposite side of the bag (i.e., the back portion 114*b* shown in FIGS. 3–4) via the aperture 124. The product is deposited into the open bag 102 via the chute 176.

Figure 18:
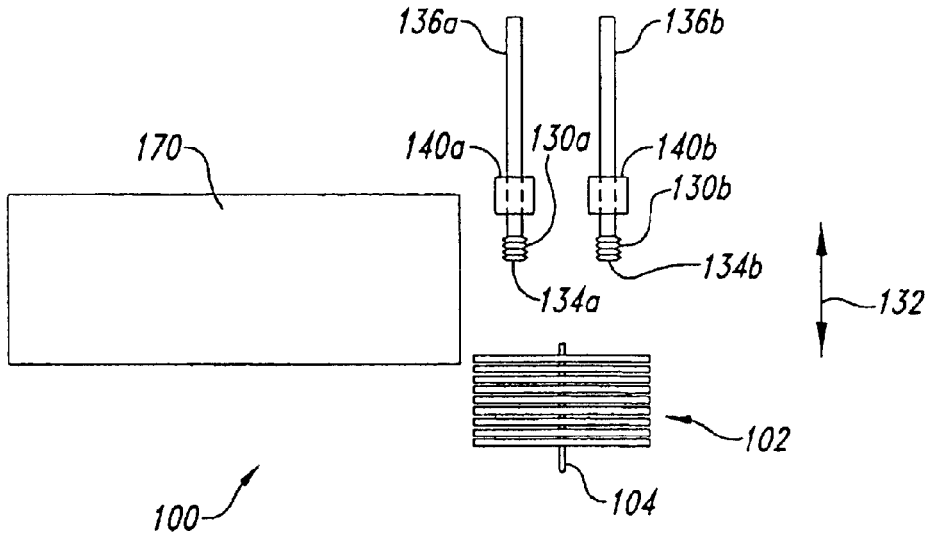
FIG. 18 is a top plan view illustrating the operation of the alternative embodiment of FIG. 14.
Figure 19:
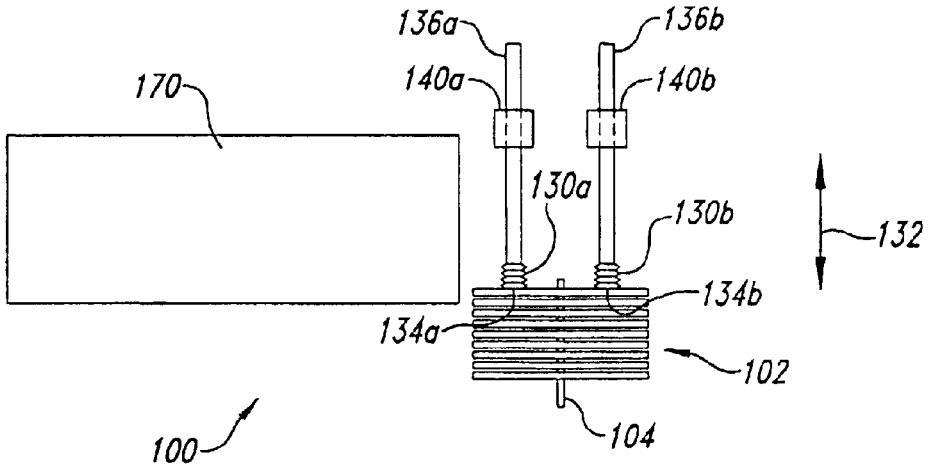
FIG. 19 is a top plan view illustrating the extraction of a bag by the apparatus of FIG. 14.
Figure 20:
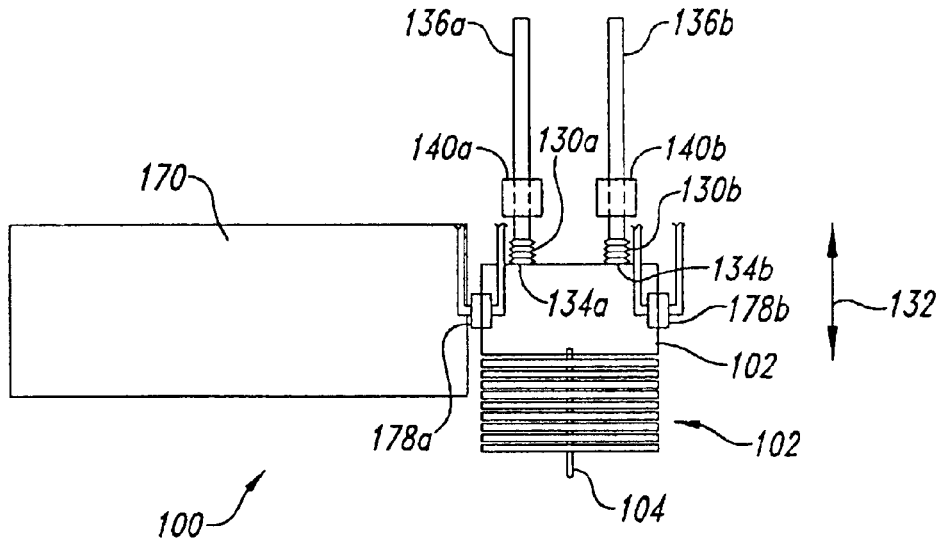
FIG. 20 is a top plan view of the apparatus of FIG. 14 with a bag in the open position.

The operation of the alternative embodiment may be best understood with respect to FIGS. 18–20. In FIG. 18, the vacuum-operated devices 130*a–b* move in the direction illustrated by the reference arrow 132 toward the first bag 102 on the protruding member 104. In FIG. 18, the vacuum-operated devices 130*a–b* move to a first position to engage a first side of the bag (i.e., the front portion 114*f*) and retain the bag. The vacuum level may be adjusted for the specific size and type of bag 102. For example, if the bale bag 102 is paper, such as shown in FIGS. 3–4, the vacuum can be set at a first level or set to a second level if the bale bag is plastic, such as polyethylene.

As the air cylinder slides 136*a–b* and the vacuum-operated devices 130*a–b* move away from the protruding member 104 in the direction indicated by the reference arrow 132 in FIG. 20, the first bag is at least partially opened. In this embodiment, no vacuum devices need be applied to the second side of the bag (i.e., the back portion 114*b*) to open the bag. Rather, the aperture 124 (see FIG. 5) on the back portion 114*b* of the bag 102 is retained on the protruding member. The air cylinder slides 136*a–b* retracts to a second position such that the first bag 102 is not fully removed from the protruding member 104, but is merely opened. Thus, the air cylinder slides 136*a–b* and the vacuum-devices 130*a–b* reciprocate between first and second positions, illustrated in FIGS. 18 and 19, respectively, to contact and open a single bag 102.

The open bag 102 is retained in position below the chute 176 by gripper members or clamps 178*a–b*, illustrated in FIGS. 17 and 20. The clamps 178*a–b* may be operated mechanically, hydraulically, electrically, or in other known manners to retain the open bag 102 in position for loading. A number of different known devices may be used to implement the clamps 178*a–b*. The present invention is not limited by the specific implementation of the clamps 178*a–b*.

As noted above, the bag 102 is opened by the vacuum force applied by the vacuum-operated devices 130*a–b* on the front portion 114*f* of the bag while the back portion 114*b* of the bag is retained by virtue of the force exerted via the protruding member 104 inserted into the aperture 124 (see FIG. 5). Once the bag 102 is open, the clamps 178*a–b* grasp and retain the sides 112*l* and 112*r* (see FIG. 4) during the loading operation. Once the clamps 178*a–b* have grasped and retained the open bag 102, the vacuum-operated devices 130*a–b* can be deactivated and moved to a position that does not interfere with the loading operation.

After the open bag 102 is fully loaded, it may be placed on the conveyer belt 170 for sealing and subsequent shipment. As the fully loaded bag 102 is moved out of the loading position, it tears free from the protruding member 104 simply by ripping the bag at the aperture 124 (see FIG. 5).

Thus, the alternative embodiment illustrated in FIGS. 14–20 requires only a first set of vacuum-operated devices that move only back and forth in the direction indicated by the reference arrow 132 (see FIGS. 17 and 19) and does not require the movement of an extracted bag to a separate loading position. This alternative embodiment results in lower overall costs for the system 100, simplified operation of the system and greater throughput.

Figure 21:
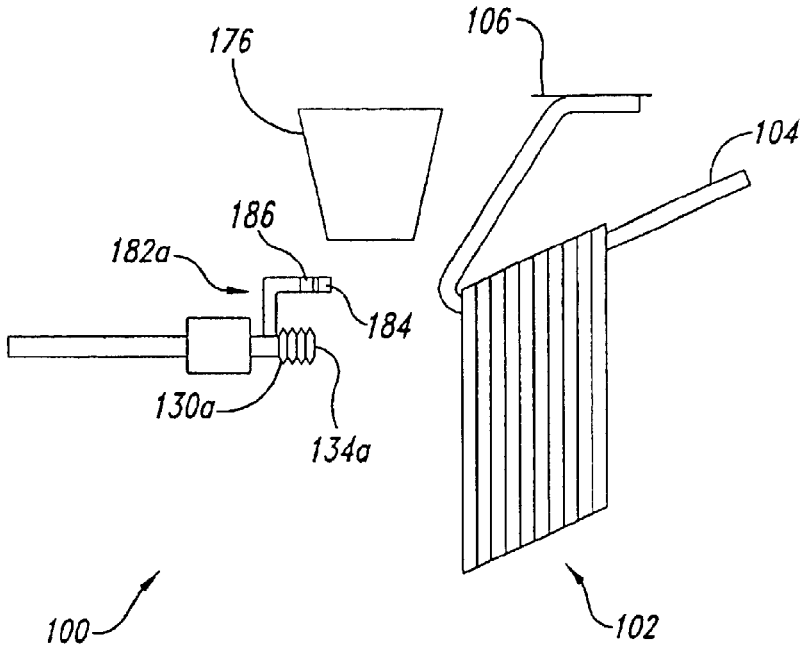
FIG. 21 is a side view illustrating another alternative embodiment.
Figure 22:
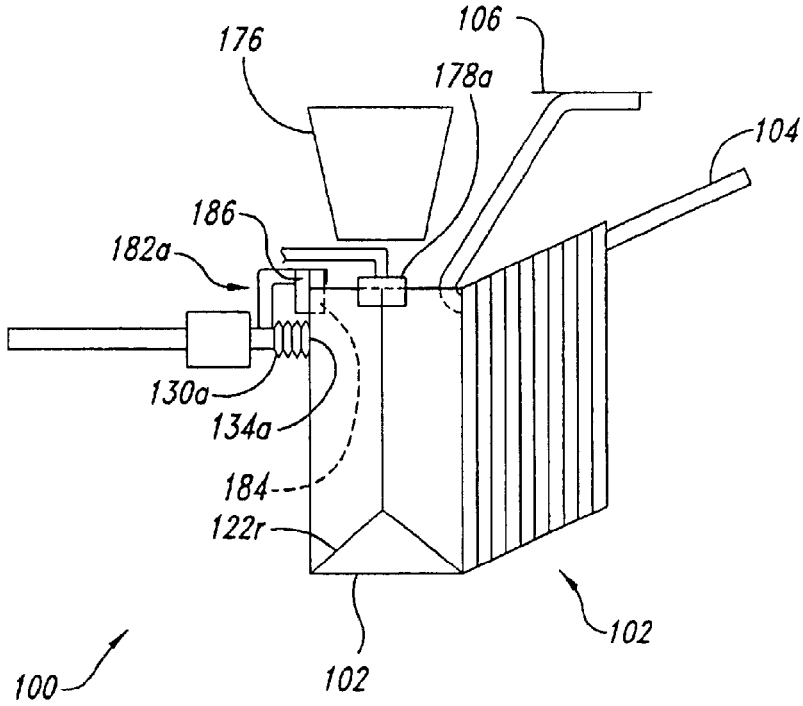
FIG. 22 is a side view of the embodiment of FIG. 21 illustrating an open bale bag.

In some applications, additional mechanical elements may be used to grip the partially extracted bag 102. For example, when the bag 102 is a plastic bag, such as polyethylene, additional mechanical gripping members 182*a–b* may be used in conjunction with the vacuum-operated devices 130*a–b* to open and retain the partially extracted bag 102. The operation of the gripping members 182*a–b* in conjunction with the vacuum-operated devices 130*a–b* is illustrated in FIGS. 21–22. In FIG. 21, the vacuum-operated device 130*a* is in the first position spaced apart from the bags 102 on the protruding member 104. In this position, the gripping member 182*a* is in a resting position. The gripping member 182*a* is activated when the vacuum-operated device 130*a* engages the first side (i.e., the front portion 114*f*) of the bag 102 and begins to partially open the bag. At that point, the gripping member 182*a* rotates into an active position to mechanically grip and retain the front portion 114*f* of the bag 102. When the bag is in the fully open position, illustrated in FIG. 22, the bag is retained by the front gripping members 182*a–b* and the clamps 178*a–b*.

Figure 23:
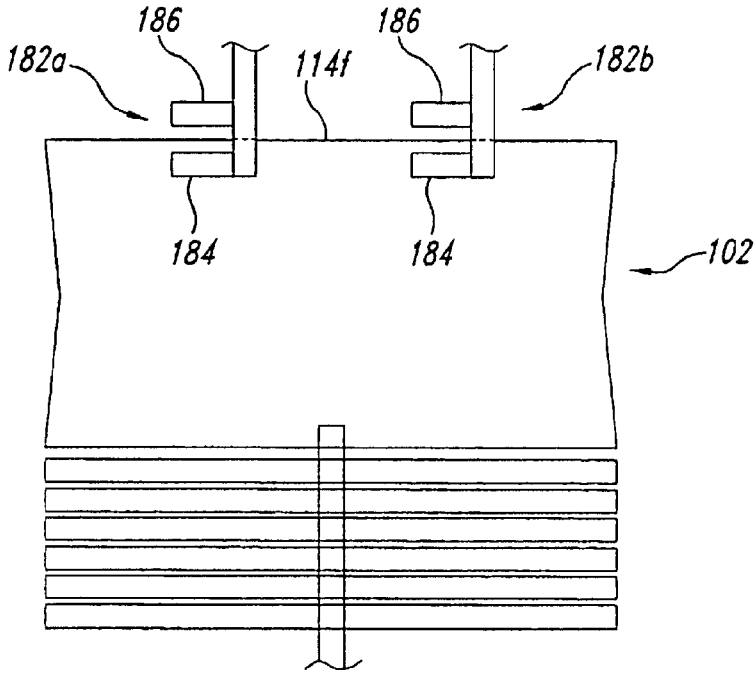
FIG. 23 is a top plan view of a portion of the system used to mechanically grasp and retain a bag.
Figure 24:
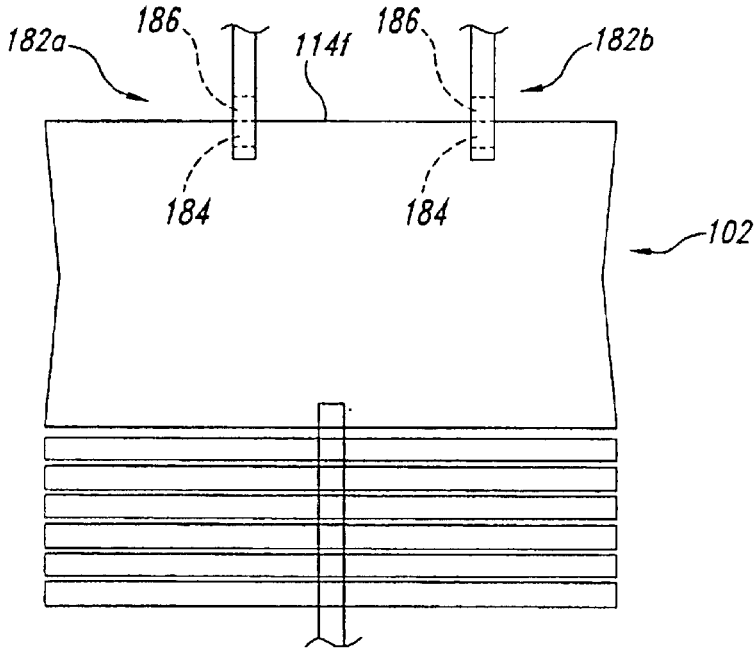
FIG. 24 is a top plan view of the embodiment FIG. 23 illustrating mechanical engagement of the bag.
Figure 25:
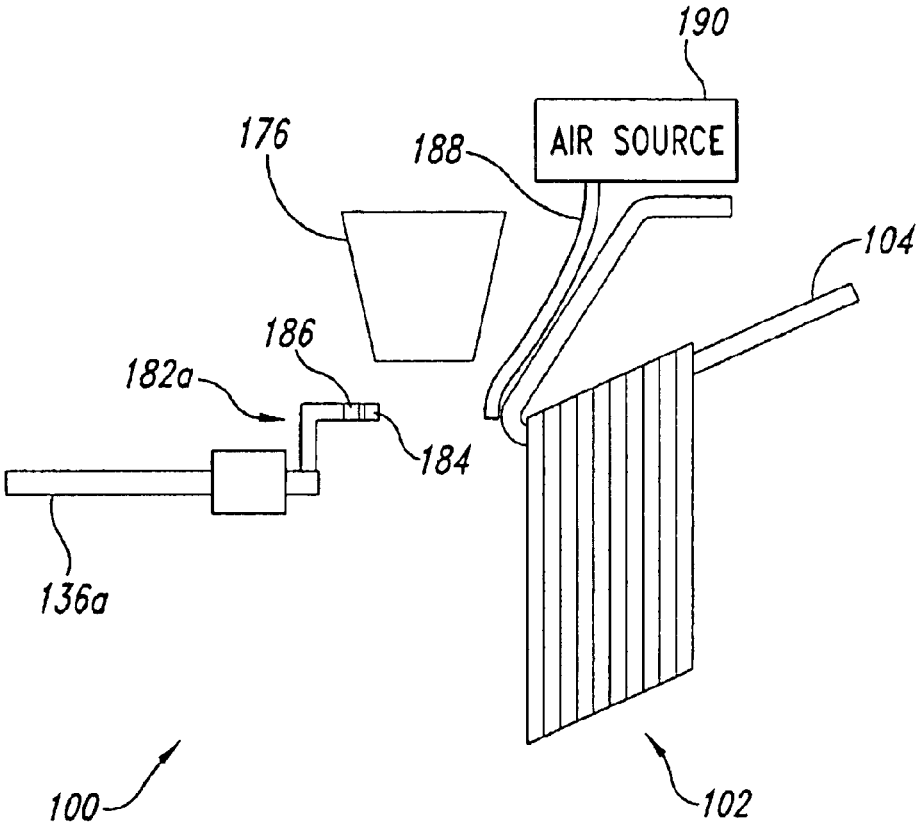
FIG. 25 is a side view illustrating an alternative embodiment.

Operational details of the gripping members 182*a–b* are illustrated in FIGS. 23–24. As best seen in FIG. 23, the gripping members 182*a–b* each comprise inner fingers 184 and outer fingers 186 to grasp and retain the partially opened bag 102 therebetween. In FIG. 23, the inner and outer fingers 184-186 are rotated to a horizontal position so as not to interfere with initial extraction of the bag by the vacuum-operated devices 130*a–b*. For the sake of clarity, the vacuum-operated devices 138*a–b* are not illustrated in FIGS. 23–24.

When the bag 102 has been partially extracted and opened by the vacuum-operated devices 130*a–b*, the inner and outer fingers 184-186 rotate such that the inner fingers 184 are projecting in a substantially vertical downward orientation inside the front portion 114*f* of the partially opened bag 102. At the same time, the outer fingers 186 are also rotated in a substantially downward vertical orientation so as to be positioned on the outside of the front portion 114*f* of the partially opened bag 102. Thus, the front portion 114*f* of the partially opened bag is positioned between the inner and outer fingers 184 and 186, respectively.

Following rotation of the inner and outer fingers 184 and 186, the relative position between the inner and outer fingers is decreased so as to mechanically grasp and retain the front portion 114*f* of the partially opened bag 102. This relative movement may be readily accomplished through the use of electromechanical actuators, motors, screw drives, vacuum-actuated devices, hydraulic devices, or the like, to move the inner fingers 184 toward the outer fingers 186. Conversely, the outer fingers 186 may be designed to move toward the inner fingers 184. Alternatively, both the inner and outer fingers 184-186 may be designed to move towards each other. Operational details of operation of the gripping members 182*a–b* are known to those of ordinary skill in the art need not be described in greater detail herein.

The operation of the gripping members 182*a–b* has been described in conjunction with the vacuum-operated devices 130*a–b*. However, in an alternative embodiment, the gripping members 182*a–b* may be used independent of any vacuum-operated device to open and extract the bag 102. In this embodiment, the gripping members 182*a–b* are attached directly to the air cylinder slides 136*a–b*, respectively, in place of any vacuum-operated device.

In this embodiment, an alternative technique must be provided to initiate partial opening of the bag 102. A tube 188 is coupled to an air source 190. As the gripping members 182-184 are moved along the air cylinder slides 136*a–b*, respectively to the first position, a burst of air from the air source 190 is directed via the tube 188 to a position proximate the aperture 24 (see FIG. 5) of the bag 102. The burst of air from the air source 190 is sufficient to partially open the bag. The gripping members 182*a–b* operate in the manner described above to engage the front portion 114*f* of the partially opened bag.

As the gripping members 182*a–b* are withdrawn to the second position along the air cylinder slides 136*a–b*, the inner and outer fingers 184-186, respectively, of the gripping members 182*a–b* grasp and retain the partially extracted bag 102. This technique is particularly useful when the bags 102 are plastic bags. However, the air source 190 may also be used to open, or at least partially open, paper bale bags. The use of air bursts to partially open bags is known to those of ordinary skill in the art and need not be described in greater detail herein.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A method for automatic loading of a paper bale bag having a top portion with an opening for loading and an apeture located in the top portion on one side thereof, comprising:

hanging the paper bale bags on a single stationary protruding member sized to fit through the aperture in the bags thereby supporting the bags in a vertical orientation;

activating a vacuum-operated engagement member at a first position to provide suction to engage a first one of the bags on a first side of the bag opposite the side of the bag having the aperature;

reciprocating the engagement member to a second position while maintaining the activation of the suction to open the bag with the second position being spaced apart from the first position such that the engagement member opens the bag but does not remove the side of the bag containing the aperture from the protruding member wherein the bag is opened by the engagement member and the protruding member, the protruding member alone retaining the side of the bag containing the aperture while the bag is being opened;

gripping left and right side portions of the open bag to retain the bag; and loading the first bag while the engagement device is at the second position and the side of the bag containing the aperture remains on the protruding member.

2. The method of claim 1 wherein activating the first vacuum-operated device comprises activating first and second suction cups to engage the first side of the first bag.

3. The method of claim 1 wherein engaging the first one of the bags on the first side of the bag comprises directing an air stream at the first side of the bag to at least partially open the bag and mechanically engaging the first side of the first bag subsequent to the at least partial opening.

4. The method of claim 3 wherein mechanically engaging the first side of the first bag subsequent to the at least partial opening comprises activating a mechanical finger assembly to engage the first side of the first bag subsequent to the at least partial opening.

5. The method of claim 1, further comprising moving the loaded bag from the position and thereby removing the loaded bag from the protruding member.

6. A method for automatic loading of a paper bale bag having an aperture located in the top portion on one side thereof, comprising:

hanging the paper bale bags on a single stationary protruding member sized to fit through the aperture in the bags;

activating a vacuum-operated engagement member at a first position to engage a first one of the bags on a first side of the bag opposite the side of the bag having the aperture; and reciprocating the engagement member to a second position to open the bag with the second position being spaced apart from the first position such that the engagement member opens the bag but does not remove the side of the bag containing the aperture from the protruding member wherein the bag is opened by a force of the engagement member applied to the first side of the bag and a force of the protruding member applied to the side of the bag containing the aperture.

7. The method of claim 6, further comprising loading the first bag at a bag loading position while the engagement member is at the second position.

8. The method of claim 7, further comprising moving the loaded bag from the bag loading position and thereby removing the loaded bag from the protruding member.

9. The method of claim 6, further comprising gripping left and right side portions of the open bag to retain the bag in a bag loading position.

* * * * *